US006315044B1

(12) United States Patent
Tinker

(10) Patent No.: US 6,315,044 B1
(45) Date of Patent: Nov. 13, 2001

(54) PRE-MILLED WINDOW FOR DRILL CASING

(76) Inventor: Donald W. Tinker, 11781 W. Torch Lake Dr., Rapid City, MI (US) 49676

( * ) Notice: Subject to any disclaimer, the term of this patent is extended or adjusted under 35 U.S.C. 154(b) by 0 days.

(21) Appl. No.: 09/438,418

(22) Filed: Nov. 12, 1999

Related U.S. Application Data

(60) Provisional application No. 60/107,976, filed on Nov. 12, 1998, now abandoned.

(51) Int. Cl.[7] ..... E21B 29/06

(52) U.S. Cl. ..... 166/298; 166/117.5; 175/61; 175/73

(58) Field of Search ..... 166/244.1, 313, 166/117.6, 50, 117.5, 298, 381; 175/61, 62, 73, 75, 77, 79, 82

(56) References Cited

U.S. PATENT DOCUMENTS

| | | | |
|---|---|---|---|
| 2,298,706 | | 10/1942 | Kothny . |
| 2,327,658 | | 8/1943 | Miller . |
| 3,349,845 | | 10/1967 | Holbert et al. . |
| 4,540,047 | | 9/1985 | Akkerman . |
| 4,540,048 | | 9/1985 | Gazda . |
| 4,765,403 | | 8/1988 | Crawford et al. . |
| 4,773,478 | | 9/1988 | Streich . |
| 4,784,222 | | 11/1988 | Ford . |
| 4,913,227 | | 4/1990 | Wittrisch . |
| 4,942,924 | | 7/1990 | Duncan . |
| 5,040,602 | | 8/1991 | Helms . |
| 5,197,547 | | 3/1993 | Morgan . |
| 5,224,545 | | 7/1993 | George et al. . |
| 5,564,503 | * | 10/1996 | Longbottom et al. ..... 166/313 |
| 5,613,560 | | 3/1997 | Jelinski et al. . |
| 5,615,740 | | 4/1997 | Commeau . |
| 5,735,350 | * | 4/1998 | Longbottom et al. ..... 166/313 |
| 5,957,225 | * | 9/1999 | Sinor ..... 175/57 |

* cited by examiner

*Primary Examiner*—Frank Tsay
(74) *Attorney, Agent, or Firm*—Robert N. Blackmon

(57) ABSTRACT

A pre-milled window casing on a casing string for allowing a cutting tool inserted into said will to contact the earth through said hole provided in said casing. Portions of a casing section along a casing string have been removed to allow drilling outwardly from the casing string at desired depths along the well. Orientation tools are provided to properly orient the window in the direction of drilling. A whip stock with an orientation nipple is inserted and mated with an orientation slot contained in an orientation sub portion of the casing string to align the whipstock with the window. A drilling tool inserted through the casing is redirected by an upper slanted face of the whipstock through the window where a hole can be bored through the earth to a gas deposit.

12 Claims, 6 Drawing Sheets

PRE-MILLED WINDOW FOR DRILL CASING

This application claims the benefit of U.S. Provisional Application 60/107,976 filed Nov. 12, 1998, now abandoned.

BACKGROUND OF THE INVENTION

1. Field of the Invention

The present invention relates to a method of preparing a hole for slant drilling, including the provision of pre-milled windows which can be oriented to any direction to provide an outlet for penetrating the earth at various depths along the casing string.

2. Description of the Prior Art

Well packers utilized for isolating a zone in a well below the packer from a zone above the packer for performing a well service operation such as perforating, formation, fracturing, or pressure containment are known. Further, it is known to use wireline apparatus to initially run a packer downhole to a selected position and to set the packer. After the packer has been set, the wireline is removed from the well and a tubing string is run down the well and attached to such packers for performing the well operations. The packer can then be remove from the well by manipulation of the tubing string and by shearing pins, one-direction setting devices, or other means, freeing the packer from the well casing and pulling the tubing string and packer out of the well as a unit. The packer can then be redressed and used again in the same well or used later at a different location.

It is also known to insert a whipstock into a well casing to provide a angled surface for directing a drill or similar tool outward from the centerline of the well towards a wall to drill through the casing wall and into the earth to tap a natural gas deposit at a particular depth.

It has not been possible prior to this invention to provide a pre-milled window in the casing in conjunction with an orientation device, which, when used in combination with the whipstock, allow a drill to be inserted and aligned with the window such that the drill can be manipulated through the window to contact the surrounding earth directly without having to drill through the casing.

None of the above inventions and patents, taken either singly or in combination, is seen to describe the instant invention as claimed.

SUMMARY OF THE INVENTION

Accordingly, it is a principal object of the invention to an orientation device and casing and packers for slant drilling outwardly from within a well.

It is another object of the invention to provide a pre-milled window for allowing a drill tool inserted in the well to pass through the window to contact and drill through the earth surrounding the well.

It is a further object of the invention to provide orientation devices to position the window facing a desired drilling direction relative to the earth, and to position the whipstock in a desire position relative to the window to guide the drill through the window to facilitate slant drilling.

Still another object of the invention is to provide a method of establishing a well casing having a plurality of windows along the casing for allowing slant drilling at predetermined locations along the well casing to slant drill at various depths along the well.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT(s)

The present invention is an improved apparatus and method for improved slant drilling from within a well casing by providing pre-milled windows at the point of drilling along the casing wall and a method therefor.

Figure 5:
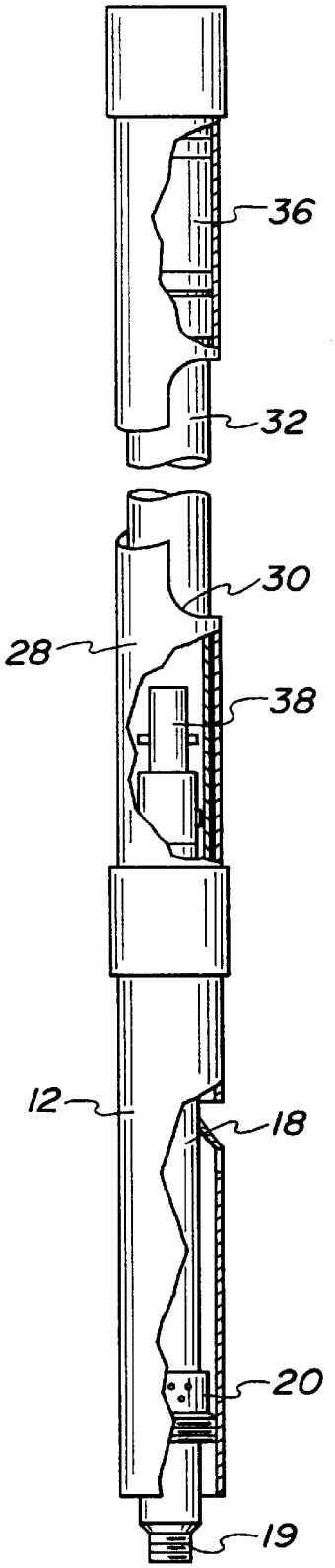
FIG. 5 is front plan view of the orientation component installed below the pre-milled window casing.
Figures 7, 8, 9:
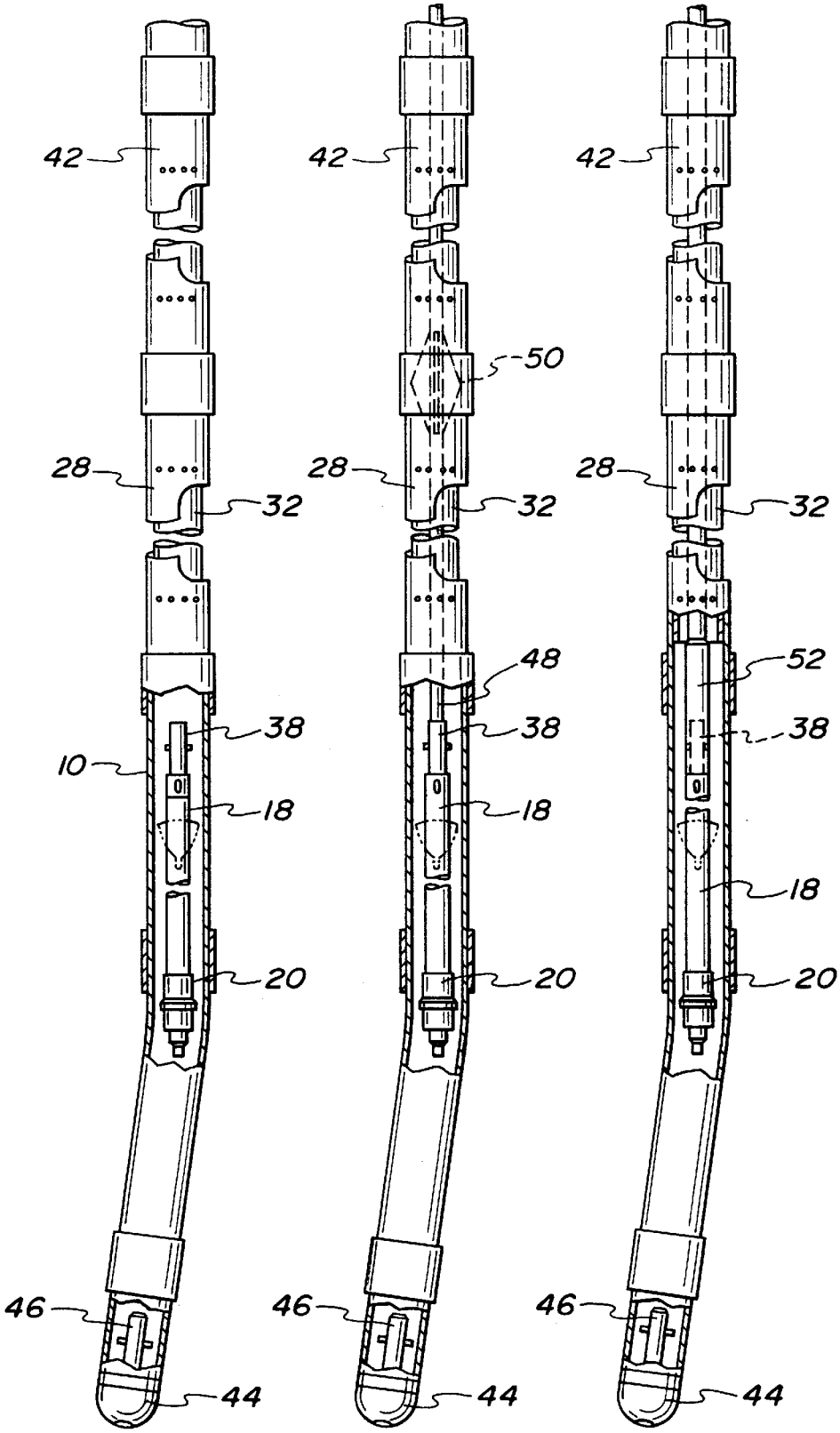
FIG. 7 is a partial sectional view of two pre-milled windows installed and positioned at a predetermined depth along the well casing.
FIG. 8 is a partial sectional view of the orientation J tool inserted to rotate the window casings.
FIG. 9 is a partial sectional view of the tool catcher inserted into the well to remove the gyro orientation sub.

As best shown in the Figures, the improved apparatus and its method will now be explained in detail. As best seen in FIGS. 5 and 7, the entire casing string and the various components are sequentially place and locked into place. Several packers and stingers are used to temporarily position other components while setting or positioning other parts, as will become clear with the description.

Figure 1:
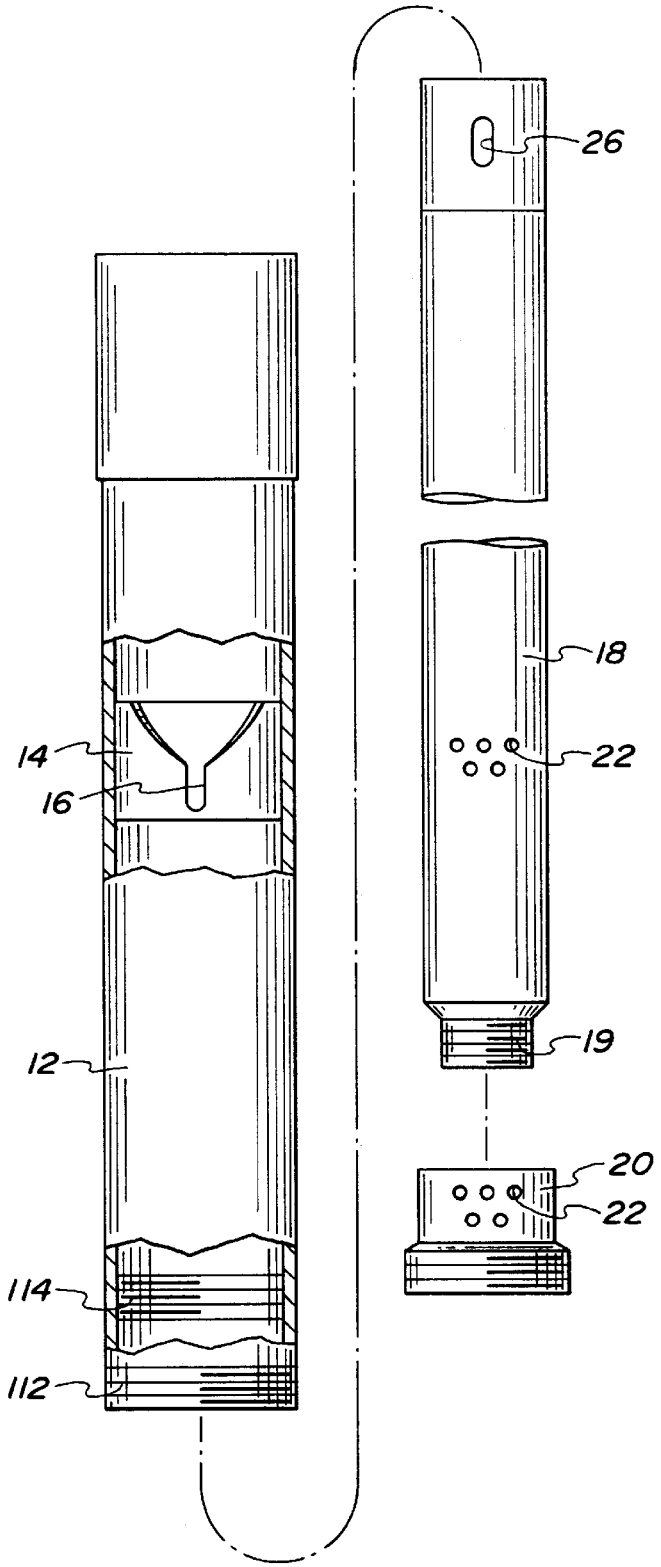
FIG. 1 is a front sectional view of the assembly of the orientation components of the casing string with a breakaway section showing the orientation nipple.
Figure 2:
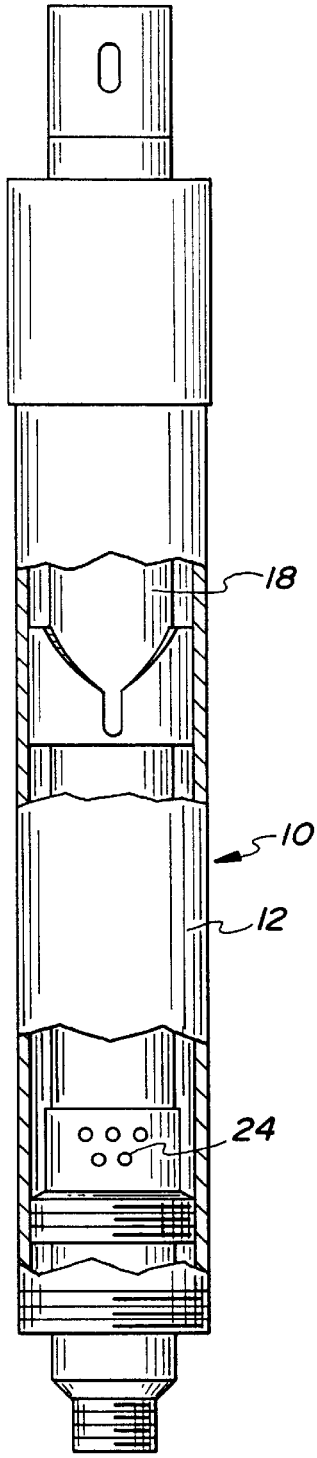
FIG. 2 is a front sectional view of the orientation components assembled together to form the orientation sub.

At the center of the invention, referring first to FIGS. 1 and 2, the four is components of the orientation sub section of the casing string are shown. The orientation sub is used to position the pre-milled window section (Window) of the casing (FIG. 3) and used to orient the whipstock (FIG. 6) into the desired position facing the pre-milled window section.

The orientation sub has a casing section 12 (orientation sub casing) consisting of a first length of piping made of steel or other suitable material. A first end of the casing has male threads 112 on an outer portion of the casing and a second end of the casing has female threads (not shown) on an inner portion of the casing allowing the casing sections to me threadedly engaged with adjacent sections of the casing. A orientation ring 14 has a whip pack orientation slot 16 at a lower end thereof. A smooth curved upper surface of the orientation ring directs a mating orientation nipple such as shown as nipple 40 (FIG. 6) to slide downwardly from the upper surface of the ring into the slot 16 and prevents further rotation of the orientation nipple. The purpose of this alignment device will be explained further below.

In a preferred embodiment as shown the orientation ring has an outer diameter slightly less than the outer casing 12. The ring is welded in place or otherwise affixed inside the casing at the desired height. The ring has an inner diameter sufficiently great to pass other components therethrough.

A second section of tubing forms a spacer shear sub 18 which mates with shear sleeve 20. A number of aligned shear pin holes 22 in the spacer shear sub and shear sleeve allow shear pins 24 to be placed in the holes to connect the spacer shear sub to the shear sleeve. The shear pins may be interference fit, welded, threaded or otherwise affixed in place. The number of pins and their material may be selected such that the pin shear when a certain amount of compressive or torsional or other forces is placed upon the pins. According to the present invention, the pins are selected to shear upon a combined force of 12,000 pounds.

Once the spacer shear sub and the shear sleeve have been connected by the appropriate shear pins, the two components are slid through the orientation casing 12 and threaded through mating threads on the lower portion of the shear sleeve 20 and on the inner portion threading 114 of the casing 14. The gyro orientation slot 26, which is a slot formed in the tubing of the spacer shear sub, is then aligned with the whip pack orientation slot 26 using a laser or other measuring device to precisely align the components of the orientation sub 10. The sleeve 20 is then welded into place or otherwise permanently attached to the orientation casing 12 and fix the gyro and whip pack orientation slots 26,16.

Figure 3:
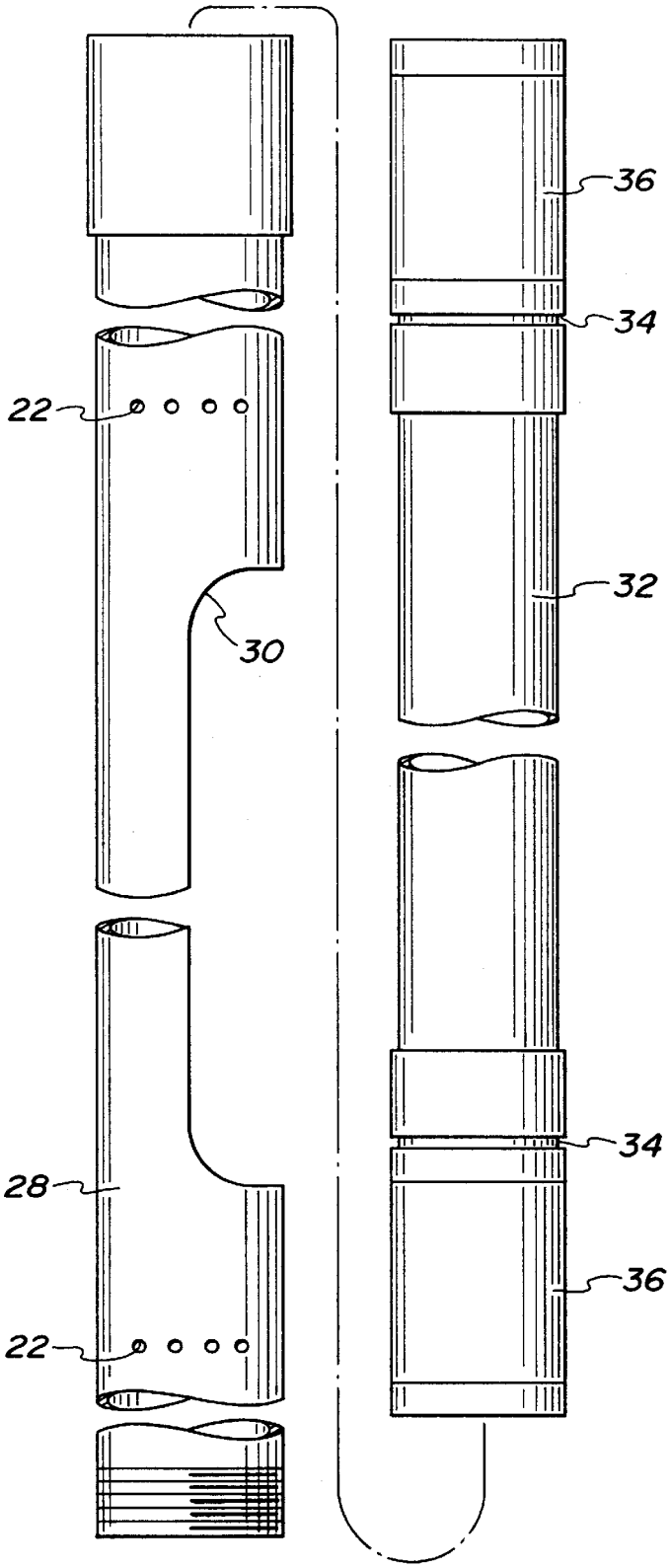
FIG. 3 shows a front plan view of the pre-milled window casing and whip-pack sleeve.
Figure 4:
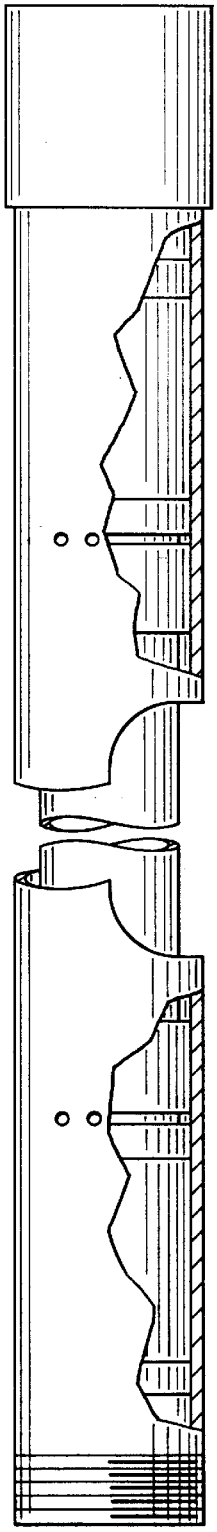
FIG. 4 is a front sectional view of the whip-pack inserted into the pre-milled window casing.

Proceeding now to FIGS. 3–4, FIG. 3 shows a length of casing 28 which is substantially similar to the length and dimensions of the orientation sub casing 12. The casing has a portion of the casing removed by milling or other suitable techniques to form a pre-milled casing window 30 (Window). The window is sized and proportioned to allow a drill or other tool to pass through the window to contact the earth or other material surrounding the casing after the casing has been positioned in a well. In the preferred embodiment, the window is substantially half the circumference of the casing, but may be smaller or larger depending on the needs of the particular application. The casing 28 has a number of shear pin holes 22 for pinning a whip pack sleeve 32 therein. The whip pack 32 is sized so as to be slidable within the casing 28. Annular groves 34 provided about the sleeve are positioned in alignment with the circumferentially spaced shear pin holes 22. In operation, the whip pack sleeve is inserted through the casing 28 and shear pins are inserted through the shear pin holes 22 of the casing 28. The pins are inserted so as to abut the inner diameter of the annular slot 34 such that the whip pack sleeve is rotatably received within the casing 28.

To control the relative rotation of the whip pack sleeve within the casing, a number of packs 36, or selective expandable seals, are provided at an upper an lower position along the whip pack sleeve. The use of packs, packers, or expandable seals is well known in the art to provide both separate the zone above and below the packer and to fix the outer sleeve relative to the inner sleeve carrying the pack.

A second purpose of the whip pack sleeve is to seal the window against foreign elements and against materials such as cement or other fixing materials poured around the casing from entering the casing. Before the whip pack sleeve is inserted into the casing 28, the whip pack is pressure tested, greased, wrapped and then shear pinned in place. A suitable material of plastic, cloth, or other similar material can be place between the window and the whip pack sleeve to hold the grease in place and to prevent liquids from entering the casing or destroying the integrity of the grease or interfering with the removal of the whip pack sleeve.

Referring now to FIG. 5, a unit consisting of the pre-milled window casing and the orientation sub connected together is shown. The upper portion of the unit consists of the casing 28 with the whip pack sleeve 32 visible through the window 30 of the casing 28. A removed section at the top of the casing shows the packer 36 of the whip pack sleeve within the casing 28. Threadedly attached to the pre-milled window casing 28 is the orientation casing 12, with the spacer shear sub 18 and the shear sleeve in place. If desired, as shown in FIGS. 7–9, a second pre-milled window casing 42 can be installed to the top of the casing 28 and having all of the same components. More than two can also be added depending on the depth of the well and the anticipated drill points as will be explained later below. Irregardless of the number of pre-milled window casings, there will need only be installed one orientation sub. The orientation sub will be installed beneath the lowest pre-milled window casing.

Attached to the top of the (inner) spacer shear sub 32 is an on off stinger 38. The on-off stinger is a tool known to those skilled in the art, and is used to apply torsional or appropriate pressure to a device to cause an action such as the shearing of shear pins in order to set or remove a tool from the casing and the well. The operation of which will be more fully explained further below.

Referring now to FIGS. 7–9, the installation of the well string components will be described. FIG. 7 shows a casing string according to the current invention comprising an orientation sub 10, a first pre-milled window casing 28, and a second pre-milled window casing 42. The initial casing string has been run in the hole with the windows spaced to the desired vertical distance from each other. If necessary, lengths of casing can be installed between the pre-milled window casing 28 and the second pre-milled window casing 42 to space the windows apart at the predetermined spacing. Packoffs (Packers) 36 are in place and set (expanded) to keep the whip pack sleeve and casing 28 sealed against each other.

Also shown, as in FIG. 5, located above the space shear sub 18 is an on-off stinger 38 in place above the spacer shear sub. Located at the very bottom of the casing string and closing off the casing from the environment is a valve box 44 and lower on-off stinger 46.

FIG. 8 shows the insertion of a gyro orientation J-tool 48 and centering spacers 50 by wire line. The gyro orientation tool has been run in through the center of the casing, through the whip pack sleeve, through the hollow, cylindrical on-off stinger 38 and mated with the gyro orientation slot. Through the use of above ground reading equipment (not shown) the position of the gyro tool is known. By rotating the gyro orientation tool or other suitable orientation tool, the outer casing 12 of the orientation sub 10 and the pre-milled window casing 28 can also be rotated. Since the gyro orientation tool 48 is inserted into the gyro orientation slot, and the orientation ring orientation slot is aligned with the gyro orientation slot, the position of each can be accurately fixed from above ground. The orientation of the pre-milled window casing 28 can thus be set, and along with it the exact orientation or direction of the pre-milled. The gyro orientation tool can then be removed from the casing after completion of the orientation process.

In FIG. 9, an on-off tool catcher 52 is tripped into the well casing and latched onto the on-off stinger 38. The tool catcher is shaped so as to securely engage the stinger with the outer prongs (nipples) of the stinger engaging interior slots of the tool catcher as shown in phantom lines in FIG. 9. This engagement allows torque to be supplied from the tool catcher to the stinger an to the spacer shear sup 18 below the stinger.

Once engaged, the tool catcher 52 can provide either tension, compression, torque or other pressure to the spacer shear sub 18 shearing pins 24 which hold the spacer shear sub 18 to the shear sleeve 20. By example, a typical force of 12,000 lbs. may be required to fail the shear pins. The spacer shear sub 18 is now free of the orientation sub casing 12 and shear sleeve 20, and can be tripped to the bottom of the casing with the stinger 38 and tool catcher 52 (shown together as block 56). The threaded end 19 of the spacer shear sub can then be engaged with or latch onto the lower on-off stinger 46, establishing communication of the interior of the tube 54 with valve 44. This allows communication from the surface through the tube running the entire length of the casing to the bottom valve 44 which controls flow between the interior of the casing and the environment directly below the casing.

Figure 10:
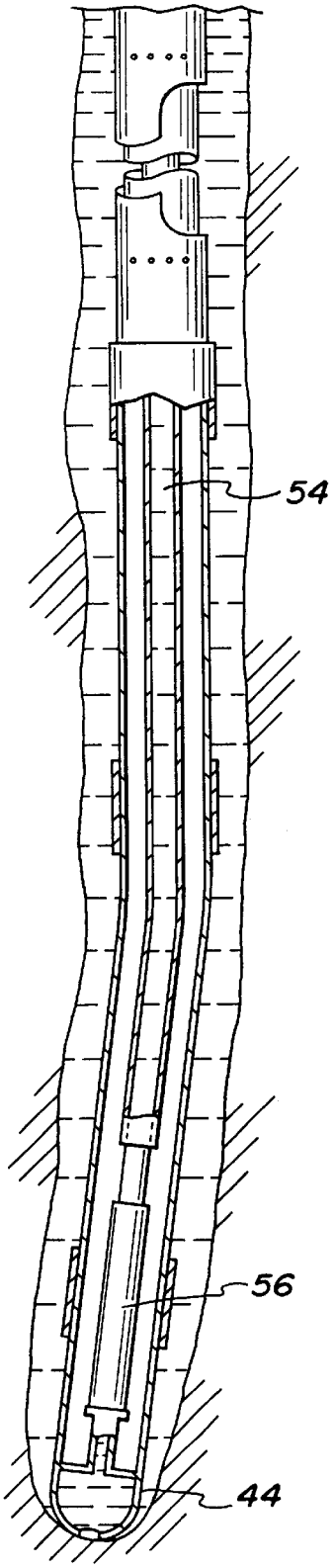
FIG. 10 is a partial sectional, environmental view of the well casing with the tubing latched onto the lower on-off stinger and having water circulating through the tubing and out the casing.
Figure 11:
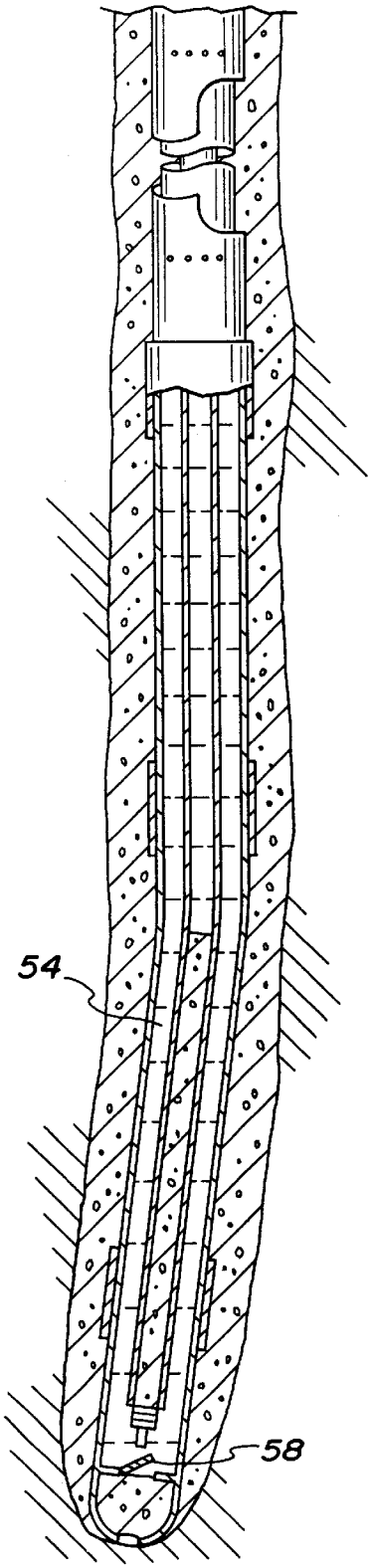
FIG. 11 is a partial sectional, environmental view of the well casing being cemented in place and with the on-off stinger removed to prevent further flow from the tubing to the outside of the casing.
Figure 12:
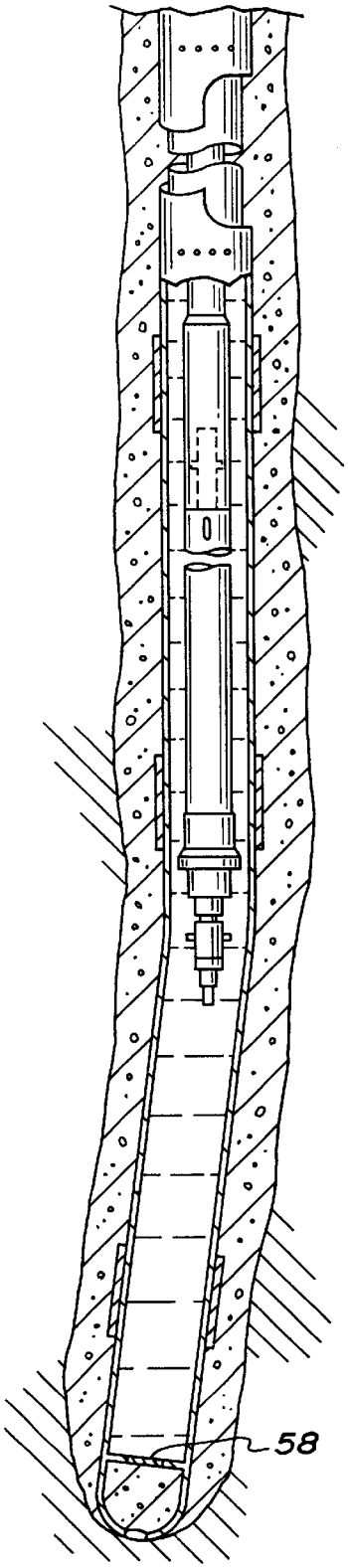
FIG. 12 is a partial sectional, environmental view of the well casing with the tools being tripped out of the hole.

FIGS. 10–12 show the steps of permanently establishing the casing string in place in the well. Once the communication between the surface and the valve 44 has been established, a flow of water or similar fluid is flowed through the tube string 54 through the tool catcher, stinger, and spacer sheer sub (collectively at 56), through the valve 44 to the surrounding well. A ball valve or similar one way valve allows flow from the casing out to the environment, but does not allow flow back into the casing.

The water then travels between the walls of the well and the casing (outer annulus) back to the surface. When the operator (not shown) is satisfied that a steady flow circuit exists from the surface through the tube string 54 out the casing and back to the surface, the operator shuts down the flow of water. Substantially simultaneously with shutting down the water flow, the operator starts a flow of cement down the tube string. Once the cement has displaced the water inside the tube string, out of the casing and back to the surface, the cement flow is halted. Once it is ensured that the bottom ball valve (not shown) is properly seated to prevent reverse flow of the cement back into the casing, preparations are made to remove the tube string.

As shown in FIG. 11, with the ball valve in the closed position, no flow of cement can flow back into the casing. The lower on-off stinger can then be removed safely. Rotation of the tube string 54 causes rotation and removal of the on-off stinger through the attached components 56 which transfer the torque. As the on-off stinger is removed from the valve box 44, a second, flap valve 58 closes to prevent flow from the tube string or interior casing into the valve box 44. This is necessary to prevent water pressure from the casing string or tube string to displace cement surrounding the bottom of the casing.

Water is then circulated through the tube string 54 into the casing interior and back to the surface to clean any remaining cement out of the casing string. The valve 58 directs water from the tube string back through the casing around the tube string and back to the surface. After the cement is cleared from the casing, the tube string along with the attached tool catcher, spacer shear sub, and both stinger tools are tripped out of the casing as shown in FIG. 11. The cement is then allowed to cure for 12 hours or more establishing the casing string permanently in the well.

Figure 13:
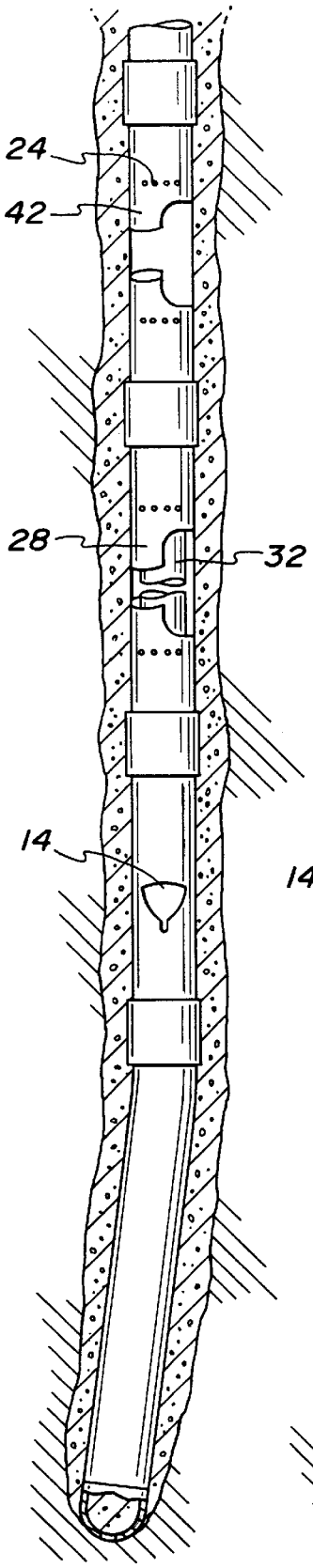
FIG. 13 is a partial sectional, environmental view of the well casing with the upper whip-pack sleeve removed after cement hardening.
Figure 14:
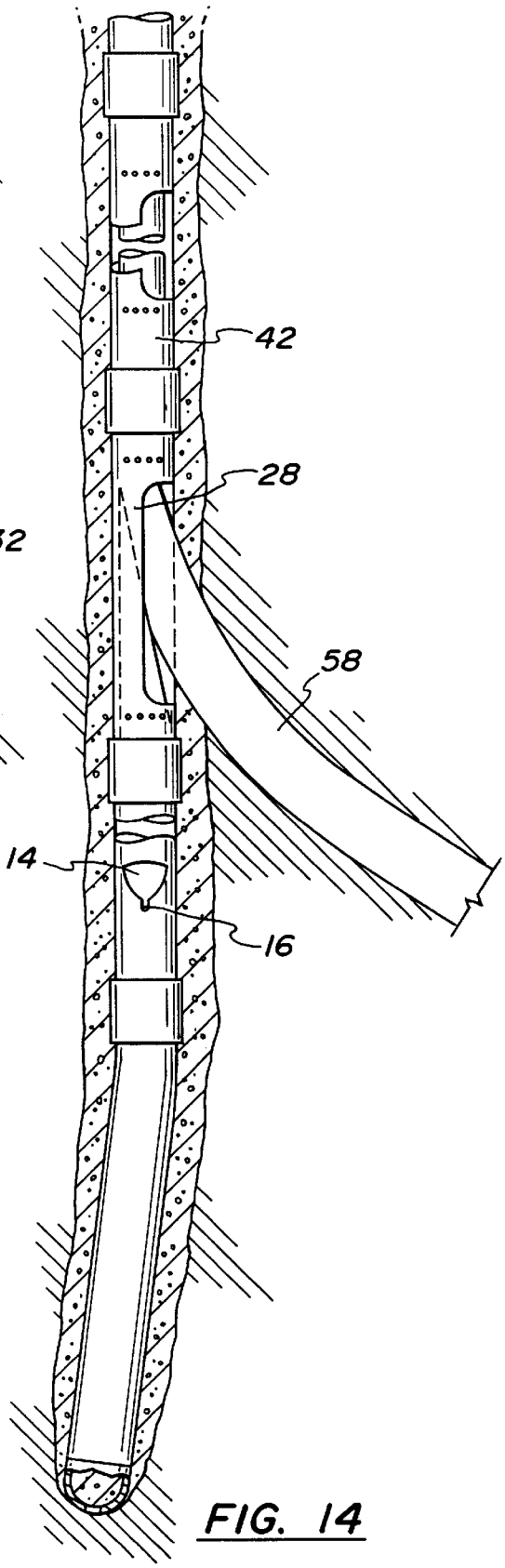
FIG. 14 shows the whipstock in place and oriented to face the window and having a drill tool passing though the window.

Referring to FIG. 13, the removal of the whippack sleeves will not be explained. In each pre-milled window casing, of which two are shown in the drawings labeled as 28 and 42, a whippack sleeve has been pinned in place by a plurality of shear pins 24. To remove the whippack sleeve 32, a casing spear (not shown) is introduced into the casing which will grapple itself onto the whippack packoff sleeve 32. By use of compression or tension or torque, the pins can be sheared to release the whippack from the casing, releasing the packoffs 36 from the pre-milled window casing 28. It is then possible to trip out with the casing spear and whippack sleeve 32. The use of the grease and covering sheet of plastic or cloth ensures that the cement has not attached to the whippack sleeve and the sleeve can be freely moved up the casing for removal. FIG. 13 shows the upper pre-milled window casing 42 with the whippack sleeve removed and the lower pre-milled window casing with the whippack sleeve still in place. This process must be repeated for each pre-milled window casing, removing the upper most window casing first and repeating for each window casing below that until the lowermost window casing is removed. At this point, the only orientation device remaining in the well will be the orientation ring having the whipstock orientation slot.

Figure 6A:
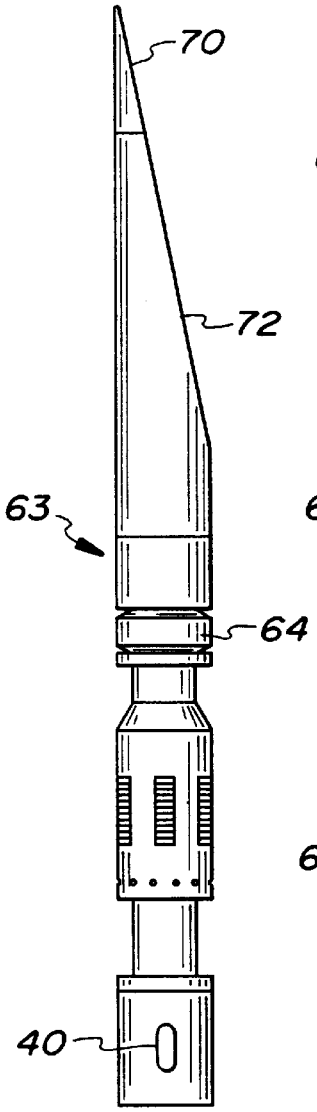
FIG. 6A shows a front plan of the whipstock.
Figure 6B:
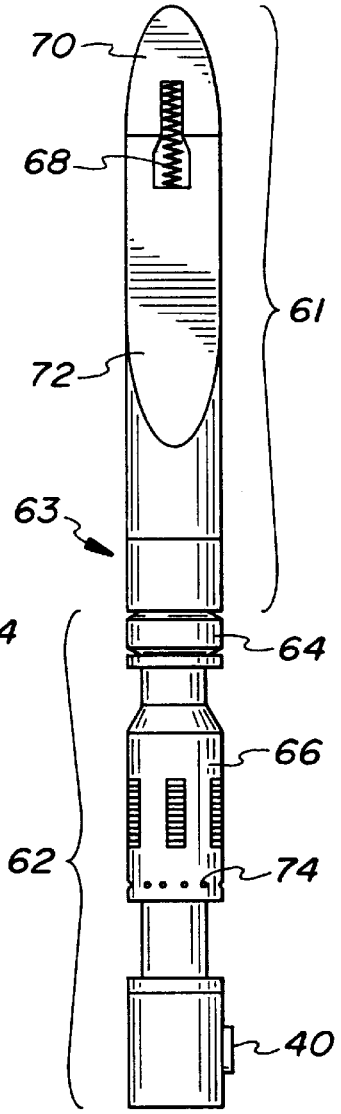
FIG. 6B shows a side plan view of the whipstock.

Referring now to FIGS. 6A&B and 14, the well is now ready to begin the drill out. FIGS. 6A&B show a whipstock 61 and whippack 62 combined into one unit 63. Located at the top of the whippack 62 is a packoff element 64 and a ratchet activation unit 66. Upon insertion of the whippack and whipstock into the casing unit, the orientation nipple 40 at the bottom of the whippack will engage the orientation ring 14 and slide or can be rotated until the orientation nipple 40 engages the slot 16. With the orientation nipple engaged and aligned in slot 16, the inclined face 72 of the whipstock will face the window 30 of the pre-milled window casing 28. The weight of the whiptock tool and the insertion (running) tool (not shown) will cause the packer to compress the packer 64 towards the ratchet activation device 66 also causing the packoff 64 to expand and release from the running tool by shear pins (74) inserted between the running tool (not shown) and the whippack in a similar manner as described with the shear sleeve and the whippack sleeve. When the running tool has been removed, an upper extension 70 of the whipstock inclinded face that is spring loaded by a torsional spring 68 or other device, extends to mate against the inner face of the casing. This prevents any further tools inserted into the casing from catching on the top of the whipstock and allows a smooth transition from the vertical casing to the inclined face 72 of the whipstock. The running tool can then be tripped out of the hole.

With the whipstock inclined face and the window properly aligned, a drill or other cutting tool can be inserted in the casing. As shown diagrammatically at 58, a drilling tool inserted into the case will travel down the length of the casing until striking the inclined surface of the whipstock. The drill tool will then be directed outward to the void in the casing left by the pre-milled window 30. The drill can then be operated to drill through the cloth or plastic that was inserted to between the whippack sleeve 32 and the window 30. The drill will then contact the cement sleeve which was poured into the annulus between the casing and the earth. The drill will cut through the cement at substantially the angle of the whipstock allowing the angle to be controlled by selecting the appropriate angle of the whipstock 72. The drill can then continue until the operator determines that a gas pocket has been struck or until reaching the selected parameters for the operation. The casing will not be in communication with the gas reserve and appropriate, known equipment can be inserted or attached to direct the gas into the desire receptacles or conduits.

The use of multiple windows allows multiple test holes or operation holes to be bored at the desired, pre-selected heights. A record of the total length of the casing string components can be kept on file so that later additional holes can be drilled through the windows using whippacks and whipstocks which have a height appropriate to lead the drilling tool or other digging tool through the selected window. The use of the windows will save substantially on the timing and difficulty which is presently associated with having to drill through the casing of the well before establishing contact of the drilling equipment with the earth. The result will be substantial savings from the time and the destruction of cutting tips or blades along with the various advantages of being able to drill in an accurately gauged, preselected direction. In addition, the repeatable orientation of the drilling direction will allow the operator to re-tap a hole at a particular level without hunting and guess as to the location of the previously drilled hole.

The dimensions shown in the drawings have been compressed vertically to show the various parts in their relation to each other. The final dimensions and aspect ratios will be dependent on the size of the well, its depth and other factors which will be apparent to one skilled in the art. It is also to be understood that the present invention is not limited to the embodiment(s) described above, but encompasses any and all embodiments within the scope of the following claims.

I claim:

1. A well comprising a casing string having a pre-milled window casing section defining a window and an orientation means for directing a tool downwardly through the casing and out of said window, said casing string including a concentric whip pack sleeve inserted in said window casing section for preventing foreign matter from entering said window while said whip pack sleeve is installed.

2. A well casing string having an orientation sub for orienting a selectively insertable whip stock having an orientation nipple, said orientation sub including an orientation ring having a slot welded to an interior portion of said orientation sub, said orientation ring having a whip pack orientation slot for orienting a whip stock, whereby when said whip stock is tripped into said casing, said whip stock orientation nipple will engage said orientation ring slot to align said whip stock relative to said orientation slot.

3. The well casing string of claim 2, further comprising a window casing section in said casing string to define an opening in said casing for accessing the earth surrounding an exterior of said casing string.

4. The well casing string of claim 3, further comprising:

a whippack sleeve selectively insertable in said window casing section for preventing foreign matter from entering said window while said whippack sleeve is inserted in said window casing section while said whippack sleeve is installed.

5. The well casing string of claim 4, further including a drill selectively insertable in said casing, wherein said whipstock directs said drill into said window to engage the earth surrounding the exterior of said window casing section.

6. A method of establishing a well comprising the steps of:

a) providing a length of casing;

b) providing a section of casing having a pre-milled window and an inner whippack sleeve;

c) providing said whippack sleeve with grease and covering material;

d) attaching said pre-milled window casing section to said casing.

7. The method of claim 6, further including the steps of:

e) providing an orientation sub having an orientation ring and a shear sleeve attached to an inner surface of said orientation sub, and a spacer shear sub shear pinned to said shear sleeve.

8. The method of claim 7, further including the steps of:

f) providing said spacer shear sub with a gyro orientation slot;

g) attaching said orientation sub to said casing;

h) providing an on-off stinger attached to said spacer shear sub;

i) providing a valve box having at least one valve at the bottom of said casing;

j) providing a lower on-off stinger tool to an upper portion of said valve box.

9. The method of claim 8, further including the steps of:

k) drilling a well of a predetermined depth and angle;

l) inserting said casing in said well;

m) inserting an orientation tool into said casing until said tool mates with said orientation slot;

n) orienting said window in a desired orientation;

o) removing said orientation tool.

10. The method of claim 9, further including the steps of:

p) inserting a tool catcher and hose into said casing until said tool catcher engages said on-off stinger;

q) shearing said pins between said shear sleeve and said spacer shear sub;

r) trip said tool catcher and said on-off stinger and said spacer shear sub to a bottom portion of said casing.

11. The method of claim 10, further including the steps of:

s) engaging said spacer shear sub with said lower on-off stinger;

t) establishing a flow of water through said hose through said tool catcher through said lower on-off stinger and into said valve box and out from said casing to said well surrounding said casing;

u) flowing cement through said hose to displace said water in said hose and in an annulus surrounding said casing string;

v) halting said flow of said cement after displacing said water.

12. The method of claim 11, further including the steps of:

w) removing said lower on-off stinger from said valve box;

x) removing said whippack spacer sleeve;

y) inserting a whipstock having an orientation nipple into said casing;

z) mating said orientation sub with said orientation slot to align said whipstock with said window;

aa) inserting a drill tool through said casing and through said window.

* * * * *